United States Patent [19]

Clark

[11] 4,123,648

[45] Oct. 31, 1978

[54] KEY FOR DEFROSTING LOCKS

[76] Inventor: Bob J. Clark, Rte. #5, Box 2054, Port Angeles, Wash. 98362

[21] Appl. No.: 757,717

[22] Filed: Jan. 7, 1977

[51] Int. Cl.[2] ..... H05B 3/06

[52] U.S. Cl. ..... 219/521; 70/456 R; 362/203; 219/201; 219/267

[58] Field of Search ..... 219/200, 201, 220, 242, 219/267, 385, 521, 523, 202, 228, 230; 240/6.4 K, 10.6 R, 10.6 CH; 70/431, 456 R, DIG. 46

[56] References Cited

U.S. PATENT DOCUMENTS

| | | | |
|---|---|---|---|
| 2,530,513 | 11/1950 | Drugan | 219/201 |
| 2,558,441 | 6/1951 | Jones | 219/267 X |
| 2,774,855 | 12/1956 | Simmons | 219/201 X |
| 2,965,741 | 12/1960 | Blazina | 219/200 |
| 3,022,408 | 2/1962 | Wagner | 219/201 X |
| 3,379,854 | 4/1968 | Jovis | 219/201 |
| 3,450,859 | 6/1969 | Brucker | 219/201 |
| 3,703,634 | 11/1972 | Bucky | 240/10.6 CH |
| 3,723,704 | 3/1973 | Silverthorne | 219/242 |
| 3,973,422 | 8/1976 | Cervera | 70/431 |

*Primary Examiner*—J. V. Truhe
*Assistant Examiner*—M. Paschall
*Attorney, Agent, or Firm*—Warren T. Jessup

[57] ABSTRACT

A device for heating keys comprised of a plug which fits the socket of a cigarette lighter having means for heating a key. The device is comprised of a heating element surrounding a slot in the plug into which a key may be inserted for heating. The plug, when pushed into the cigarette lighter receptacle, activates the heating element which in turn heats the key. The device can be constructed as a slot in an existing cigarette lighter for use in conjunction with it, or may be a separate adapter plug. The device is activated by pushing the key into the slot in the plug or cigarette lighter and engaging the contacts by pushing the plug inward.

6 Claims, 11 Drawing Figures

KEY FOR DEFROSTING LOCKS

BACKGROUND OF THE INVENTION

This invention relates generally to devices for heating keys for defrosting locks, and more particularly relates to a device for serving the dual purpose of heating a key and operating a cigarette lighter.

With the advent of gasoline shortages, more and more locking gas caps are coming into use. In addition, other locks about an automobile or as used on outdoor enclosures could quickly become frozen during the cold winter months in many parts of the world. In order to defrost the locks when they have become frozen, various methods have been used. Methods such as pouring hot water on the locks are temporary solutions, and freezing of the water can cause the problem to return.

For that reason, devices have been devised which will heat the key so that the lock can be defrosted by insertion of the heated key into the key slot. These devices, while providing a solution to the problem, are not altogether satisfactory because they are either complicated and difficult to construct and use, or they provide serious hazards. One such device has a heater constructed right into the lock which is engaged by pushing the key into the key slot. This device could be very hazardous if incorporated into some type of locking gas cap for obvious reasons. Also, it would be ineffective if the lock itself was frozen for one could not get his key into the key slot for heating. Another device provides a flame-type heater which may be activated in the same manner as a cigarette lighter and certainly would not be advantageous. In each of the prior art devices, special construction or mounting is necessary to adapt the particular device.

The invention disclosed herein solves these problems by utilizing existing automobile circuitry with a minimum of modification.

BRIEF SUMMARY OF THE INVENTION

The purpose of the present invention is to provide a key for defrosting frozen locks which can be provided with a minimum of modification to an automobile.

The key heater of the present invention is provided as an additional element of the existing cigarette lighter in an automobile or can be supplied as an adapter plug. The device has a body with a cigarette lighting element on one end and a key-receiving slot recessed in the knob of the cigarette lighter at the opposite end. The heating element in the key-receiving slot can be heated indirectly or directly as desired. The key-receiving slot has a metal heating element surrounding the slot which can be heated by proximity to the cigarette lighter heating element or can be directly heated by a heating element surrounding the slot. The device is used by inserting the key into the key-receiving slot and pushing the plug into the cigarette lighter with the locking mechanism holding the plug in the heat position in the same manner as cigarette lighters operate. When the heating element reaches a predetermined temperature, the device pops out in much the same manner as a cigarette lighter or may be held in to heat the key as much as desired.

After heating the key, the entire plug with the key still in the heating slot may be removed and carried to the vicinity of the lock to be defrosted. The key may then be removed from the plug and inserted in the frozen lock to defrost the lock. Repeat operations of heating the key can be easily performed in the event that the lock is very severely frozen.

As was indicated, there are numerous ways in which the key-heating element may be provided. Also, the plug for engaging the cigarette lighter may be incorporated into the cigarette lighter itself or may be a separate, independent plug for insertion into the cigarette lighter. Various methods of contacting the key with the heating element may be provided in the form of heating elements embedded in a suitable heat-resistant material surrounding the slot. The heating element can also be provided in the form of a high-resistant heating element which is shorted by insertion of the key. This would provide current to the heating element, which in turn would cause the key to heat.

It is one object of the present invention to provide a device for heating a key to defrost frozen locks.

Another object of the present invention is to provide a key-heating device with a minimum of modification to existing automobile accessory equipment.

Another object of the present invention is to provide a key-heating device which may be adapted to be inserted in the cigarette lighter receptacle of an automobile.

Another object of the present invention is to provide a key-heating device which may be incorporated into the cigarette lighter plug for insertion in the cigarette lighter receptacle of an automobile.

Other objects, advantages and novel features of the invention will become apparent from the following detailed description of the invention when considered in conjunction with the accompanying drawings wherein reference numbers identify like parts throughout.

DETAILED DESCRIPTION OF THE PREFERRED EMBODIMENT

Figure 1:
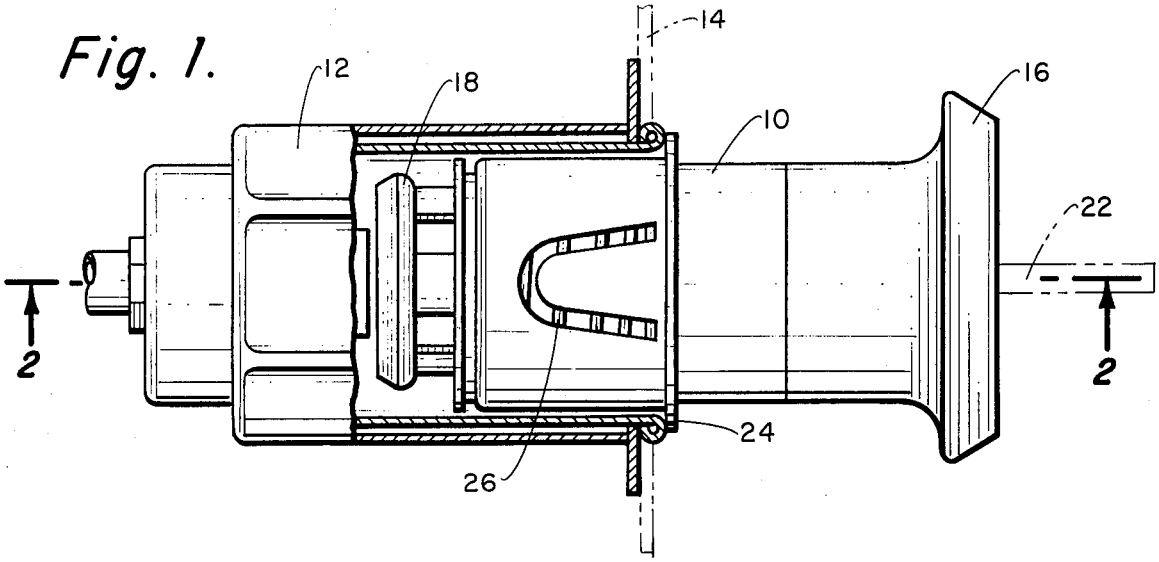
FIG. 1 illustrates one embodiment of a key heater incorporated into an automobile cigarette lighter.

The preferred embodiment of the invention is illustrated in FIG. 1. In this figure the key-heating plug 10 fits into a standard cigarette lighter socket 12 usually mounted in the dashboard 14 of a motor vehicle. The plug 10 has a knob 16 at one end and a heating coil 18 at the opposite end for use as a cigarette lighter. The key-heating element is comprised of a sheath or metallic element 20 surrounding the key 22 which is inserted in a slot 24 in the plug 10. The plug 10 has a collar 24 loaded by a spring 26 for popping the cigarette lighter out when it reaches a predetermined temperature.

Figure 2:
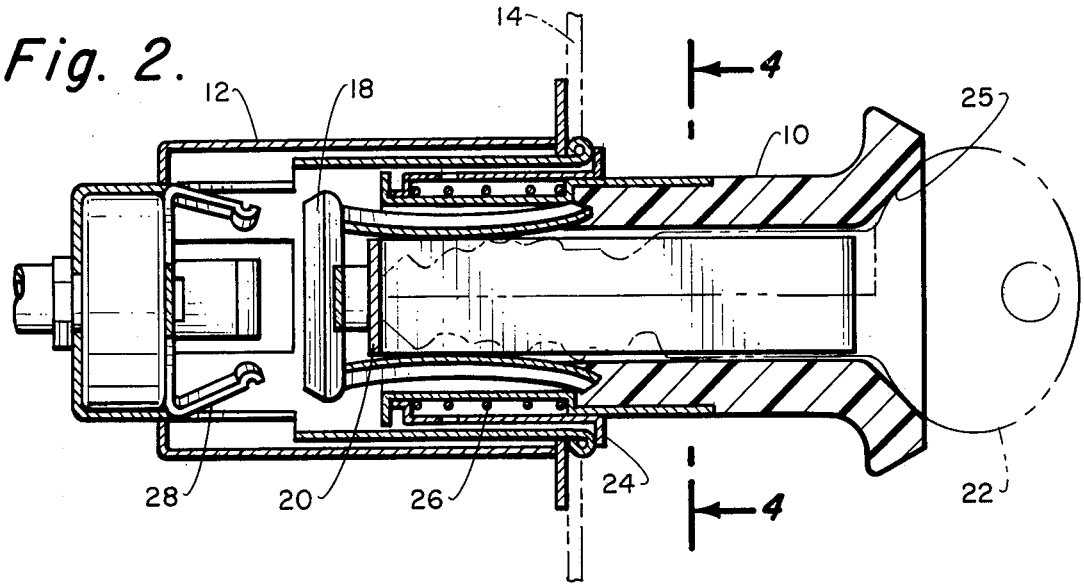
FIG. 2 is a sectional view of the embodiment shown in FIG. 1, taken at 2—2.

The device is shown in greater detail in FIG. 2 in which is a section through the plug 10 and socket 12 illustrating the manner in which it operates. The socket 12 has prongs 28 which engage the heating coil 18 of the cigarette lighter plug 10, when it is pushed into the socket 12. In the embodiment of FIGS. 1 and 2, a slot through the center of the plug 10 surrounded by the metallic sheath 20 heats the key when the cigarette lighter plug 10 is pushed into the socket. In this embodiment, the metallic sheath 20 is heated by its proximity to the heating coil 18 of the cigarette lighter socket 12, with the heating coil 18 engaging prongs 28, a circuit is completed and the coil 18 begins to heat. As it heats, it radiates heat to the sheath 20, which in turn heats the key 22. Since the plug 10 is completely surrounded by the socket 20 and may be insulated if desired, the heat is mostly contained within the plug providing sufficient heat to warm the key 22. Further, if the cigarette lighter plug should pop out or be released before the key 22 is sufficiently heated, the user can hold the plug in to keep the coil engaged and continue the heating procedure. This embodiment is the simplest because no electrical wiring to the sheath 20 for heating the key 22 is required, and merely proximity heating is utilized.

Figure 3:
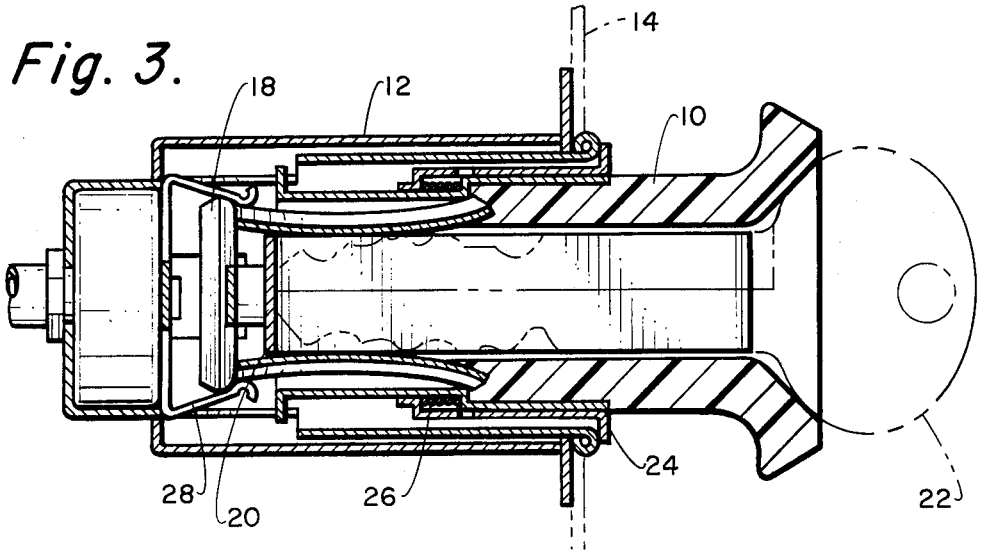
FIG. 3 is a view of the cigarette lighter of FIG. 1 also taken at 2—2 showing the device in operation position.

The device is shown in operation in FIG. 3 with the coil 18 locked in the prongs 28, holding the cigarette lighter plug 10 in the operating position. As indicated, when the coil 18 reaches a predetermined temperature the prongs 28 will release the plug 10. The user may continue the heating process by pushing the knob 16 holding the cigarette lighter plug 10 in the socket 12. When in operation, the spring 26 is compressed between the body of the plug 10 and the collar 24. When prongs 28 release the heating coil 18, the spring 26 then forces the plug outward, disconnecting the device and terminating the heating. The heating can be restarted by pushing the knob 16 re-engaging the coil 18 with the prongs 28. This completes a circuit for the heating step.

Figure 4:
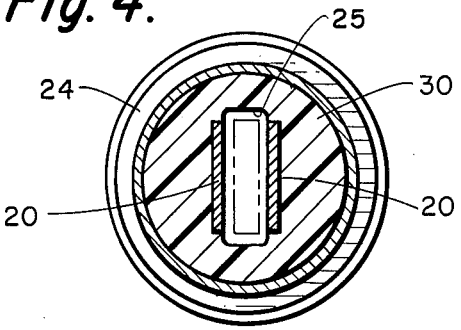
FIG. 4 is a sectional view of the key-heating device taken at 4—4 of FIG. 2.

The slot for inserting the key is shown in the section of FIG. 4. The slot 24 is moled or cut in the plastic body 30 of the plug 10. The metal sheath 20 is embedded in the plastic body or insulating material 30 and surrounds the slot 24. The end of the sheath 20 comes in very close proximity to the coil 18 and may even make contact with it if proper insulation from ground is provided. This embodiment is preferred because it is the easiest to manufacture and also the temperature of the sheath 20 is kept to a reasonable level.

Figure 6:
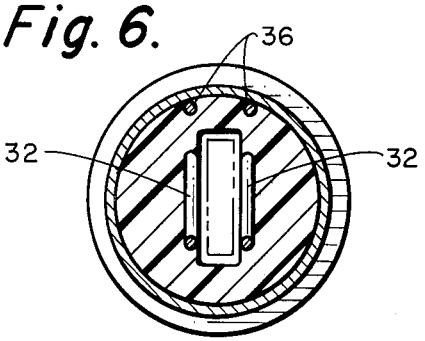
FIG. 6 is a sectional view taken at 6—6 of FIG. 5.
Figure 5:
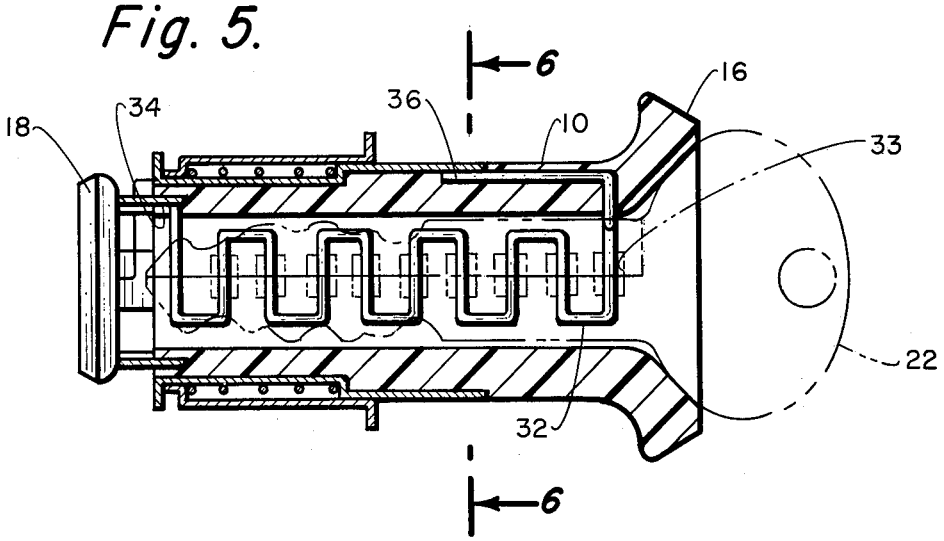
FIG. 5 is a sectional view of an alternate embodiment of the device of FIG. 1.

An alternative embodiment is shown in FIG. 5. In this embodiment the plug 10 is in the same form with the knob 16 and the heating coil 18 at the opposite end. However, in this embodiment, a heating wire or resistance element 32 may be provided, surrounding the sheath 20 or even in place of it. Heating element 32 is connected to the coil 18 at 34 with the other end of the heating element 32 being connected to the case at 36 to provide an electrical positive in most cases. The proximity of the heating coils, or coil 32, is shown in the section of FIG. 6. The coils 32 lie on either side of the slot and engage the metallic outside of the case for the plug 10, providing a ground. The coils 32 may come near contacting the blade of the key 22 or may have a thin surface of insulating material on them to prevent burning of the key and perhaps inadvertent contact through the key to some ground plane. Open slots 33 may be provided to allow direct transfer of heat from the heating element 32 to the key 22.

Figure 7:
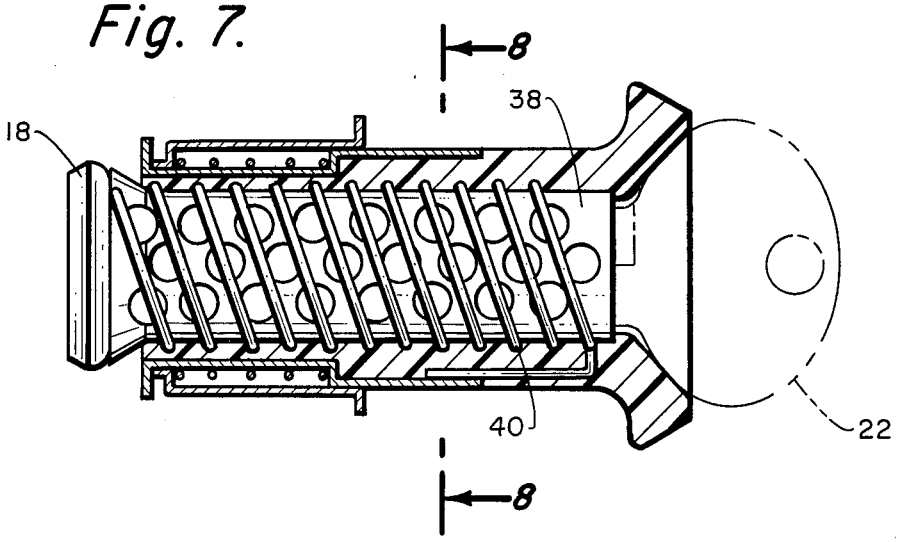
FIG. 7 is an additional alternate embodiment of the device illustrated in FIG. 1.
Figure 8:
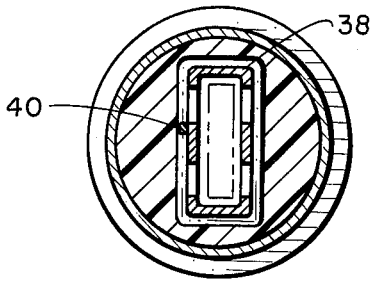
FIG. 8 is a sectional view taken at 8—8 of FIG. 7.

Another embodiment is illustrated in FIGS. 7 and 8 in which a perforated sheath 38 surrounds the slot into which the key 22 is inserted and a heating coil 40 is wrapped around the sheath and connected at one end to the cigarette lighter heating coil 18 and at the other end to ground. In the embodiment of FIGS. 5 and 7, the cigarette lighter plug 10 is pushed into the socket 12 with the knob 16 causing connection between the coil 18 and the prongs 28, completing the circuit. The cigarette lighter coil 18 heats as well as the heating element 32 (FIG. 5) or the heating coil 40 of FIG. 7. This provides more rapid and higher heating of the key 22, but requires high-temperature resistant insulation around the key-heating slot 24.

Figure 10:
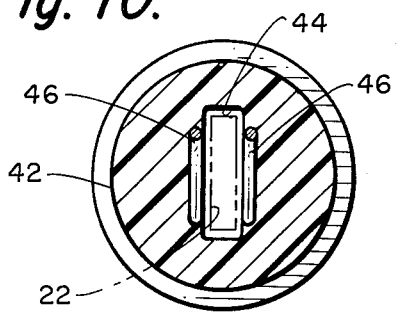
FIG. 10 is a sectional view taken at 10—10 of FIG. 9.
Figure 9:
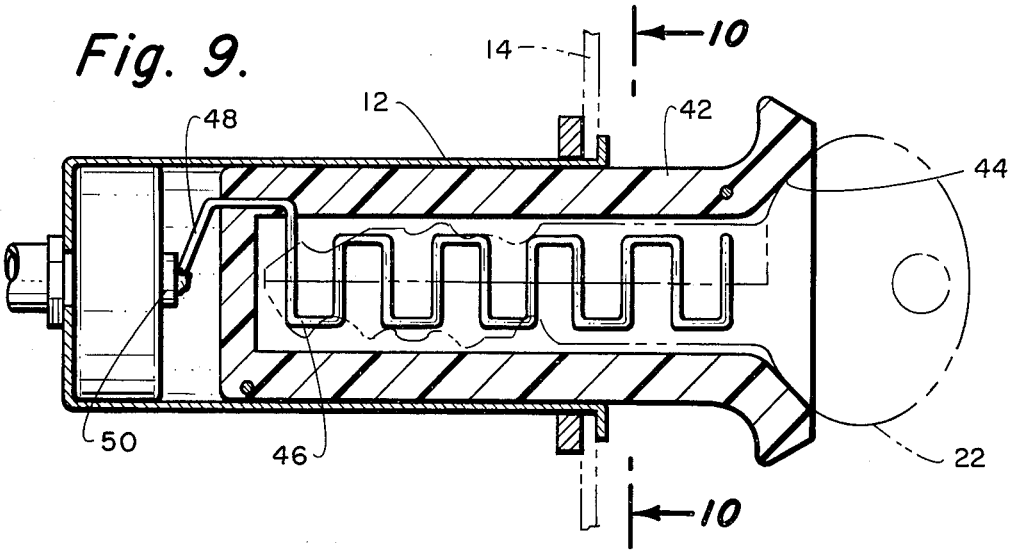
FIG. 9 is a sectional view illustrating another embodiment of the invention.

While the combination of the key heater with the cigarette lighter is preferred, for obvious reasons, the key heater can be provided as a separate adapter which plugs into an existing cigarette lighter socket in motor vehicles as shown in FIGS. 9 and 10. In this embodiment a plug 42, similar to the plug for the cigarette lighter embodiment, has a slot 44 for engagement of the key 22 as before. However, in this case the key-heating element 46 has a tab or one end has a flexible member 48 which engages a contact 50 in the cigarette lighter socket 12 completing a circuit and causing the heating element 46 to become hot. This in turn heats the key. The collar and spring operation is the same in this embodiment to keep the adapter 42 out of contact with the connector 50 so that the device must be pushed in to be operated.

Figure 11:
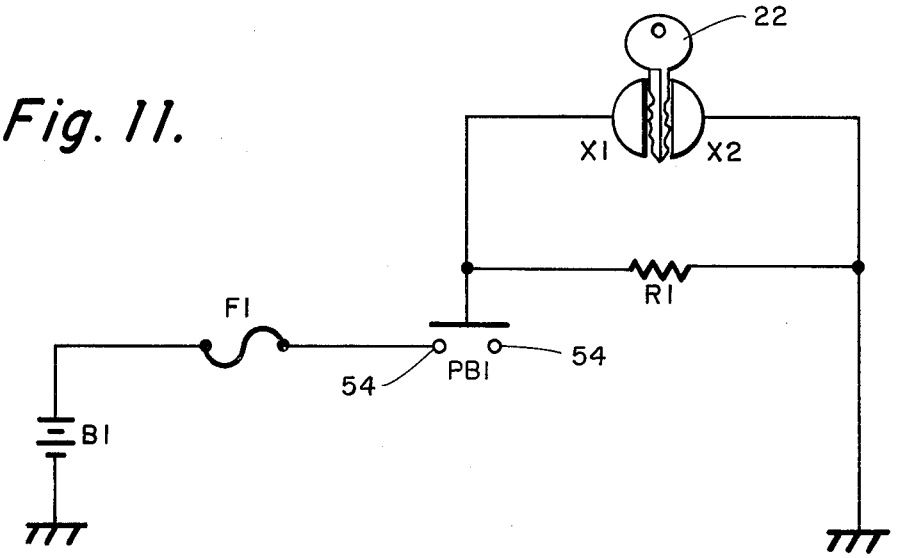
FIG. 11 is a schematic diagram illustrating the operation of the invention and also showing another embodiment.

In each of the embodiments shown, the key is heated by injection or conduction through a heating element with the key not actually acting as part of the circuit. An embodiment is shown in FIG. 11 illustrating the manner in which the electrical circuit is complete. It utilizes resistance elements on either side of the key 22 with the key acting as a conductor to connect the two elements. As before, the key is put into the slot in the slug or cigarette lighter plug and pushed in to make contact as shown by switch PB1. With the key 22 in the slot, it acts as a conductor connecting resistance element X1 to resistance element X2 passing current through the key 22 to cause it to heat. While this embodiment has advantages, it may be necessary to protect the key 22 from being grounded to other keys to the dashboard.

In operation a person who wishes to defrost a frozen lock would insert a key into the slot in the slug and for the embodiment incorporated into a cigarette lighter or in the slug 42 for the adapter embodiment engage the device and allow the key to become sufficiently warm. The entire slug can then be removed and carried to the lock to be defrosted, with the key then being removed and inserted in the lock to defrost the ice, allowing the lock to be opened.

Of course, in situations where the device would be used to unlock the locks in car doors, a socket could be provided beneath the hood. Also where the hood latch is situated, inside the vehicle, a socket could be provided in a suitable location, such as beneath the fender or close to the grill so that it can be easily reached without unlocking any locks. An important feature of the invention, however, is the incorporation of the key heater into a slug which can function with existing cigarette lighter sockets, either as an accompanying heating portion of the cigarette lighter itself, or as a separate adapter for insertion in the socket.

In the circuit of FIG. 11, the 1 represents the automobile battery, while F1 represents the standard fuse. The switch PB1 represents the contact made with the poles 52 and 54 representing the prongs 28 of the cigarette lighter socket. Thus, when the slug is pushed in, it is equivalent to making contact with the switch PB1. This contact causes current to flow through the heating element 18, represented by the resistance R1. In addition, resistance heating elements X1 and X2 are provided through which contact is made by the key 22. Thus, when the slug is pushed in, connecting the switch PB1, current flows through the path of least resistance, which, when a key is inserted in the slug, will be through resistance element X1 and key 22 and resistance element X2. This will cause the key to heat. When the key 22 is not connecting the resistance elements X1 and X2, the cigarette lighting element 18, represented by resistance R1, will provide a current path causing the device to heat for lighting cigarettes. One advantage to this particular embodiment is that the particular unit to be heated is the unit drawing the current and not both. When the device is used as a cigarette lighter, the lighting element represented by R1 will heat, but when it is used as a key heater, only the key 22 will heat.

Obviously, many modifications and variations of the present invention are possible in light of the above teachings. It is therefore to be understood that the full scope of the invention is not limited to the details disclosed herein and may be practiced otherwise than as specifically described.

What is claimed is:

1. A device for heating a key to defrost frozen locks, comprised of:

a plug formed of electrical insulating material and adapted to fit a standard automobile cigarette lighter socket;

an electrical heating coil comprising an electrical cigarette lighter heating element on the end of said plug;

energizing means for energizing said heating coil when said plug is fully inserted in said cigarette lighter socket;

a centrally located slot in said plug for receiving the blade of a key;

heat transfer means for transferring heat from said electrical heating coil to said slot when said electrical heating coil is energized;

said heat transferring means comprising a high heat conductivity material substantially surrounding said slot so that heat from said energized coil is transferred to a key inserted in said slot whereby said device functions as a dual-purpose key heater and cigarette lighter.

2. The key heating device according to claim 1 wherein said heat transferring means comprises a metallic element substantially surrounding said slot and having a portion in close proximity to said electrical coil whereby heat is conducted to said slot.

3. The key heating device according to claim 1 wherein said heat transferring means comprises a second coil substantially surrounding said slot and connected in series with said cigarette lighting coil.

4. The key heating device according to claim 1 wherein said heat transferring means comprises:

a metallic sheath surrounding said key-receiving slot;

said metallic sheath being heated by the heat generated by the cigarette lighter coil.

5. The key heating device according to claim 1 wherein said heat transferring means comprises:

a heating element surrounding said key-receiving slot; and electrical means electrically connecting said heating element in series with said cigarette lighter coil.

6. The key heating device according to claim 1 wherein said heat transferring means comprises:

a pair of resistance elements on either side of the key-receiving slot;

switch means for connecting the resistance elements into the vehicle circuit;

electrical means connecting said resistance elements in parallel with said cigarette lighter heating coil;

said resistance elements being constructed to contact opposite sides of said key when it is inserted into said slot whereby current flows through said key.

* * * * *